US008113858B1

(12) United States Patent
Chiang

(10) Patent No.: US 8,113,858 B1
(45) Date of Patent: Feb. 14, 2012

(54) CABLE CONNECTOR HAVING SWITCHING FUNCTION

(75) Inventor: Chih-Hsien Chiang, New Taipei (TW)

(73) Assignee: Cheng UEI Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/214,188

(22) Filed: Aug. 20, 2011

(51) Int. Cl.
*H01R 29/00* (2006.01)

(52) U.S. Cl. ..... 439/188; 439/441; 439/835

(58) Field of Classification Search ..... 439/188, 439/441, 786, 787, 834, 835
See application file for complete search history.

(56) References Cited

U.S. PATENT DOCUMENTS 7,607,956 B2 * 10/2009 Lang et al. ..... 439/835
7,625,253 B2 * 12/2009 Eppe et al. ..... 439/835
7,896,685 B2 * 3/2011 Eppe et al. ..... 439/441

* cited by examiner

*Primary Examiner* — Tho D Ta
(74) *Attorney, Agent, or Firm* — Cheng-Ju Chang

(57) ABSTRACT

A cable connector having switching function comprises a conductive terminal set comprising a fixed and a movable conductive terminals, an upper end of the movable conductive terminal having a slot, an upper end of the fixed conductive terminal being able to be moved relative to the slot; a switch terminal set comprising a fixed and a movable switch terminals, upper ends of the fixed switch terminal and the movable switch terminal forming a detachable connection; a linkage member pivoted in a base, an upper end of the linkage member connecting to a middle portion of the movable conductive terminal, the upper end of the movable switch terminal being placed against a lower end of the linkage member; and a pushing member slidably assembled in the base for pressing down onto the movable conductive terminal. The cable connector can fulfill circuit state determination by disposing the switch terminal set.

18 Claims, 7 Drawing Sheets

CABLE CONNECTOR HAVING SWITCHING FUNCTION

TECHNICAL FIELD OF THE INVENTION

The present invention relates to an electronic connector, and more particularly, to a cable connector having switching function.

BACKGROUND OF THE INVENTION

The electronic connector is primarily an adapter used in various electronic products for an electronic transmission. All kinds of electronic connectors have been developed with advancing electronic industry. It is a common application for utilizing a cable to electrically connect different electronic devices therebetween. When assembling the cable to the electronic device, it has to add an electronic connector to an end of the cable. The electronic connector is then connected to a conjugate connector of the electronic device such that an electronic connection and data transmission can be achieved. Therefore, cable connectors are developed and are widely used today.

The cable connector is usually used to connect the cable to a circuit board of the electronic device for transmitting electronic signals through the connections established between conductive terminals of the cable connector. However, a conventional cable connector does not have switch terminals for determining whether the cable is inserted or pulled out and determining some circuit states of the connected circuit board of the electronic device. To achieve the determination of circuit state as mentioned above, a traditional way is to add a determination circuit to the circuit board of the electronic device, correspondingly. However, this will greatly increase a manufacturing cost.

Therefore, it needs to develop a cable connector having switching function for solving the above disadvantages.

SUMMARY OF THE INVENTION

The objective of the present invention is to provide a cable connector having switching function to fulfill circuit state determination by disposing a switch terminal set for improving the above mentioned conventional skills.

To achieve the above objective, a cable connector provided in the present invention has switching function. The cable connector comprises an insulating body and also comprises a conductive terminal set, a switch conductive terminal set, a linkage member, and a pushing member assembled in the insulating body, the insulating body comprising a base and a side cover, the base having a front wall which is perforated to form an inserting hole that is provided for being inserted by a cable; the conductive terminal set assembled in the base, the conductive terminal set comprising a fixed conductive terminal and a movable conductive terminal, the fixed conductive terminal connecting to a lower end of the movable conductive terminal, an upper end of the movable conductive terminal being perforated to form a slot facing the inserting hole, a lower end of the fixed conductive terminal being extended from the base, an upper end of the fixed conductive terminal being extended to the slot and able to be moved relative to the slot; the switch terminal set assembled in the base, the switch terminal set comprising a fixed switch terminal and a movable switch terminal, an upper end of the fixed switch terminal and an upper end of the movable switch terminal forming a detachable connection, a lower end of the fixed switch terminal and a lower end of the movable switch terminal being extended from the base; the linkage member pivoted in the base, an upper end of the linkage member connecting to a middle portion of the movable conductive terminal, the upper end of the movable switch terminal being placed against a lower end of the linkage member; and the pushing member slidably assembled in the base for pressing down onto the movable conductive terminal.

Above all, the cable connector having switching function in the present invention can fulfill circuit state determination by the cooperation of the switch terminal set, the linkage member, the pushing member, and other elements, in which inserting a cable into the cable connector and pulling out the cable from the cable connector can corresponds to the "turned-on" state and the "turned-off" state of the switch terminal set. When the cable connector is in a normal state, the linkage member can press downward to the movable switch terminal such that the movable switch terminal is connected to the fixed switch terminal (the switch terminal set is in a "turned-on" state). When the pushing member is pushed to another position to press the movable conductive terminal, the movement of the movable conductive terminal can induce a rotation of the linkage member such that the pressure on the movable switch terminal is released. Therefore, the movable switch terminal is separated with the fixed switch terminal (the switch terminal set is in a "turned-off" state). In the meantime, the downward movement of the movable conductive terminal makes the slot moved down as well such that the slot is aligned with the inserting hole. The cable can be inserted into the slot and stuck in the slot. At this moment, the switch terminal set will be still in the "turned-off" state when the movable conductive terminal is forced down due to the insertion of the cable.

DETAILED DESCRIPTION OF THE INVENTION

In order to illustrate the techniques, structural features, achieved objectives and effects of the present invention in details, embodiments are provided in conjunction with drawings and are described as follows.

Figure 1:
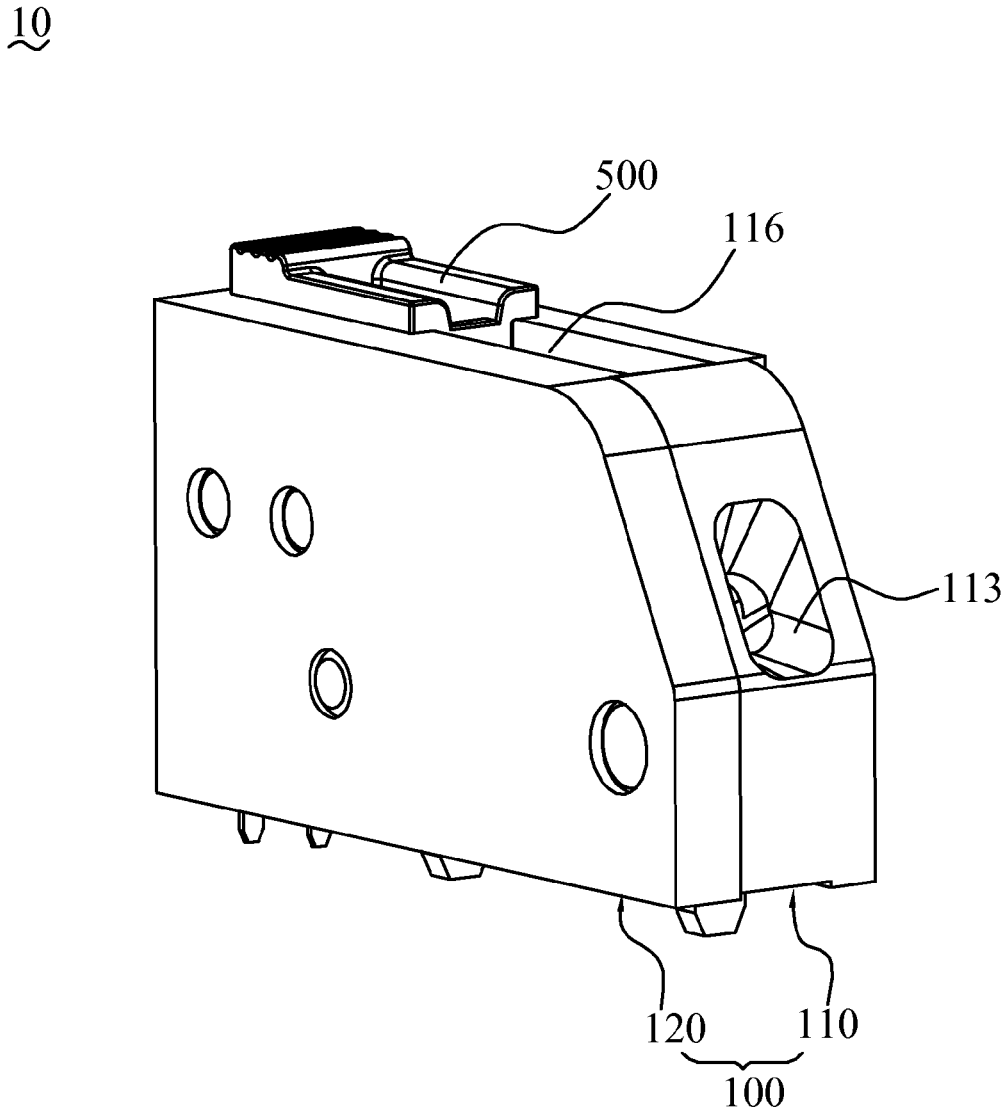
FIG. 1 is a perspective view of a cable connector having switching function in accordance with the present invention.
Figure 2:
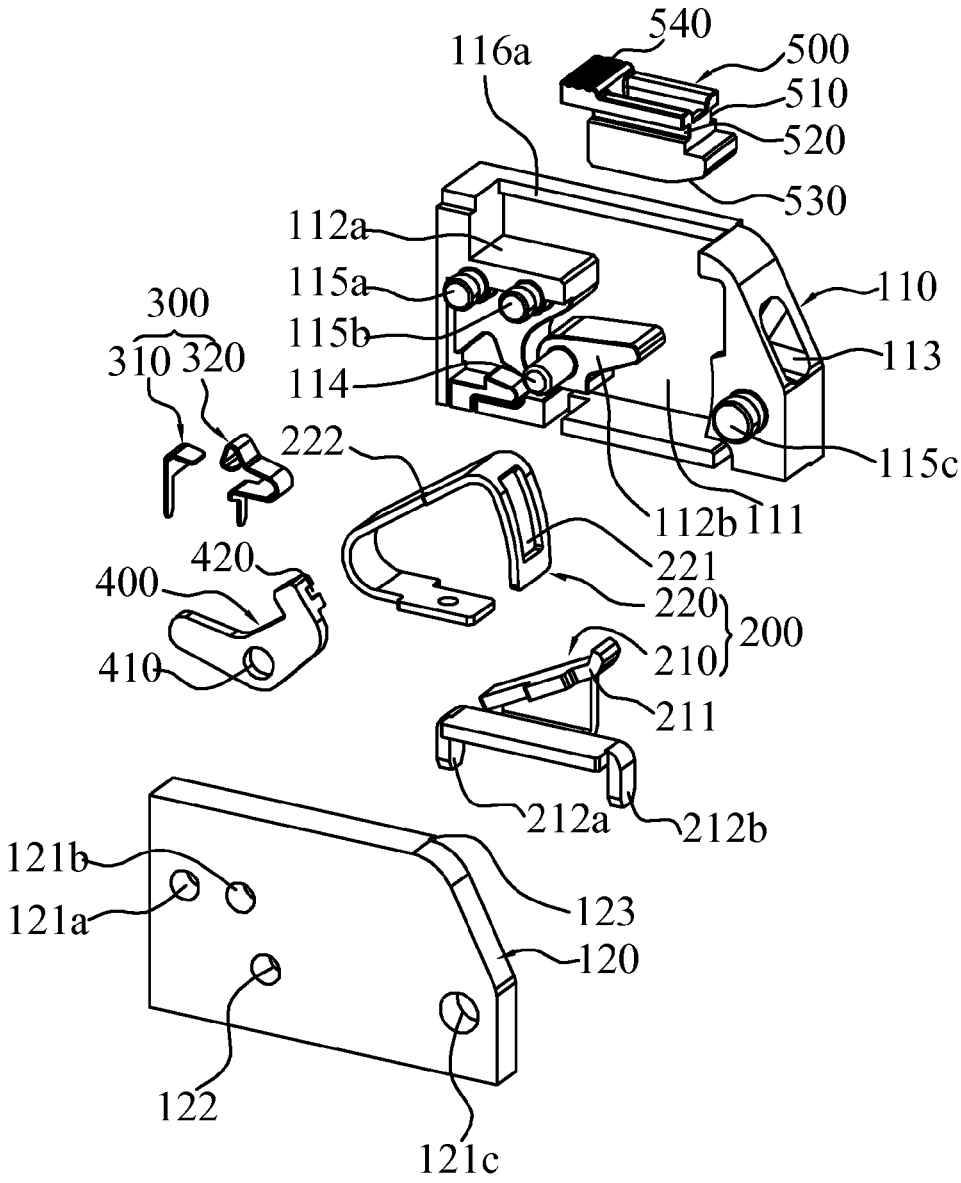
FIG. 2 is an exploded view of the cable connector shown in FIG. 1.
Figure 3:
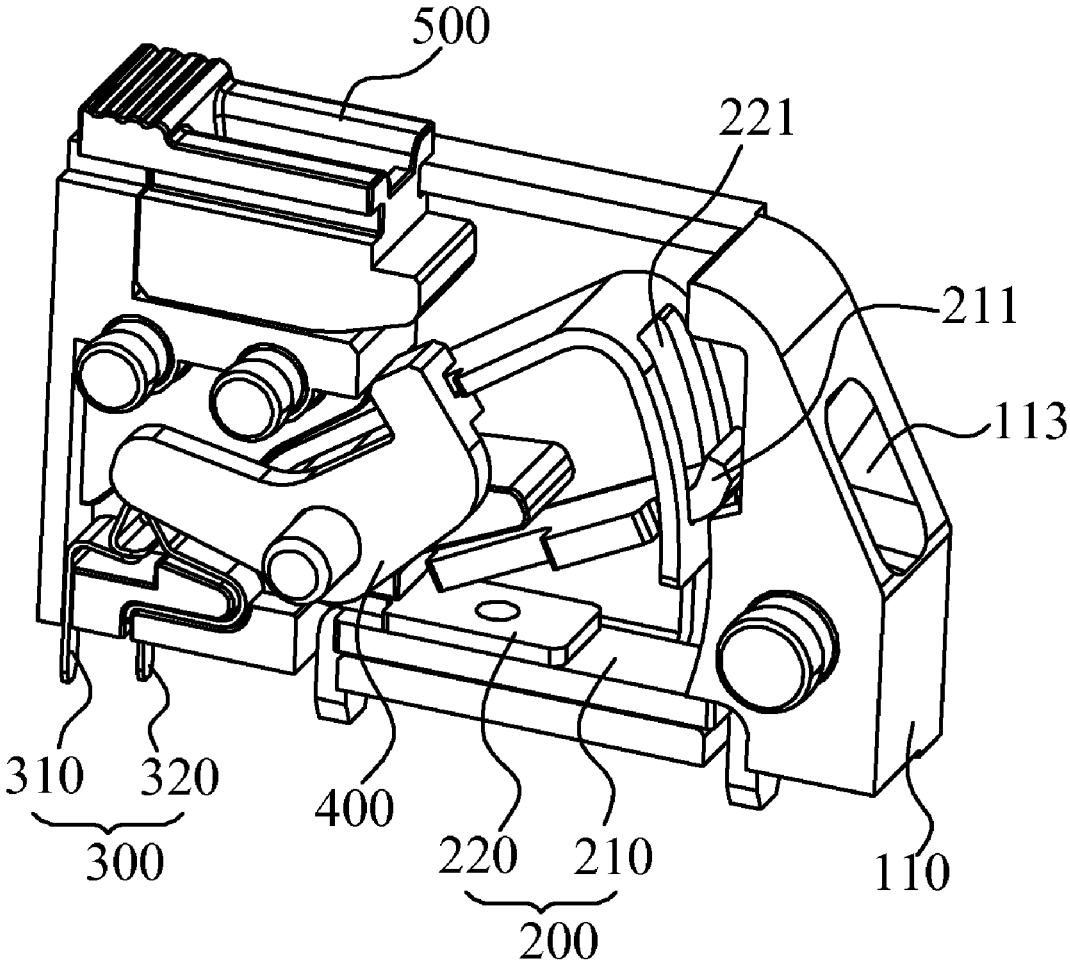
FIG. 3 is a perspective view of the cable connector of the present invention after removing a side cover.

Referring to FIG. 1 to FIG. 3, a cable connector 10 of the present invention has switching function. The cable connector 10 comprises an insulating body 100 and also comprises a conductive terminal set 200, a switch terminal set 300, a linkage member 400, and a pushing member 500 assembled in the insulating body 100.

The insulating body 100 comprises a base 110 and a side cover 120. The base 110 has a chamber 111 for accommodating the conductive terminal set 200, the switch terminal set 300, the linkage member 400, and the pushing member 500. The base 100 has a front wall which is perforated to form an inserting hole 113. The inserting hole 113 and the chamber 111 are communicated and the inserting hole 113 is provided for being inserted by a cable 600 (shown in FIG. 6). Preferably, in the present embodiment, the inserting hole 113 is a V-shaped hole or a hole having a funnel shape for being convenient to be inserted by the cable 600. Specifically, the chamber 111 has a first protruded stand 112*a* and a second protruded stand 112*b* disposed therein. The second protruded stand 112*b* has a fixed shaft 114 extended therefrom for assembling the linkage member 400. The base 110 further has three protruded shafts 115*a*, 115*b*, and 115*c* disposed thereon, wherein the protruded shafts 115*a* and 115*b* are extended from the first protruded stand 112*a*. Correspondingly, the side cover 120 is perforated to form fixing bores 121*a*, 121*b*, 121*c*, and 122 which respectively correspond to the protruded shafts 115*a*, 115*b*, and 115*c*, and the fixed shaft 114. The side cover 120 is fastened to the base 110 by engaging the fixing bores 121*a*, 121*b*, 121*c*, and 122 with the corresponding protrude shafts 115*a*, 115*b*, and 115*c*, and the fixed shaft 114.

Referring to FIG. 2 and FIG. 3 again, the conductive terminal set 200 comprises a fixed conductive terminal 210 and a movable conductive terminal 220. The movable conductive terminal 220 is wound around the second protruded stand 112*b* to form a flexible structure having certain strength. A lower end of the movable conductive terminal 220 is connected to the fixed conductive terminal 210. An upper end of the movable conductive terminal 220 is perforated to form a slot 221 facing the inserting hole 113. In the present embodiment, the slot 221 has a rectangular shape. An upper end of the fixed conductive terminal 210 is extended to form a holding plate 211. An end of the holding plate 211 is extended to the slot 221 and can be moved relative to the slot 221. A lower end of the fixed conductive terminal 210 has two conductive pins 212*a* and 212*b* formed thereon. The conductive pins 212*a* and 212*b* are extended from the base 110 for being connected to an external circuit.

The switch terminal set 300 comprises a fixed switch terminal 310 and a movable switch terminal 320. An upper end of the movable switch terminal 320 is wound to form a flexible structure having certain strength. The upper end of the movable switch terminal 320 and an upper end of the fixed switch terminal 310 form a detachable connection therebetween. A lower end of the movable switch terminal 320 and a lower end of the fixed switch terminal 310 all are extended from the base 110 for being connected to the external circuit.

A middle portion of the linkage member 400 is perforated to form a pivot bore 410. The linkage member 400 is pivoted in the base 110 by engaging the pivot bore 410 and the fixed shaft 114. An upper end of the linkage member 400 has a fixing recess 420 formed thereon. A middle portion of the movable conductive terminal 220 has a protrusion 222 formed thereon. The protrusion 222 is stuck in the fixing recess 420 such that the middle portion of the movable conductive terminal 220 is connected to the linkage member 400. In addition, the upper end of the movable switch terminal 320 is placed against a lower end of the linkage member 400 such that the motion of the movable switch terminal 320 is controllable.

The pushing member 500 has a first groove 510 and a second groove 520 respectively formed on two lateral walls thereof. A top portion of the base 110 is perforated to form an opening 116 for accommodating the pushing member 500. A first ridge 116*a* is formed at one side of the opening 116 for engaging with the first groove 510. A second ridge 123 is formed on an upper portion of the side cover 120 for engaging with the second groove 520. Therefore, the pushing member 500 can slide in the opening 116 after assembling to the base 110. Preferably, the pushing member 500 has an oblique plane 530 facing a bottom surface on a side of the movable conductive terminal 220 such that it is easily to press the movable conductive terminal 220 and move the movable conductive terminal 220 downward. Preferably, the pushing member 500 has a wave-shaped surface 540 formed on a top portion thereof such that friction on a top surface of the pushing member 500 is increased and it is convenient for a user to operate the pushing member 500.

Referring to FIG. 4 to FIG. 7, the working principle of the cable connector 10 having switching function in the present invention will be described in detail as below.

Figure 4:
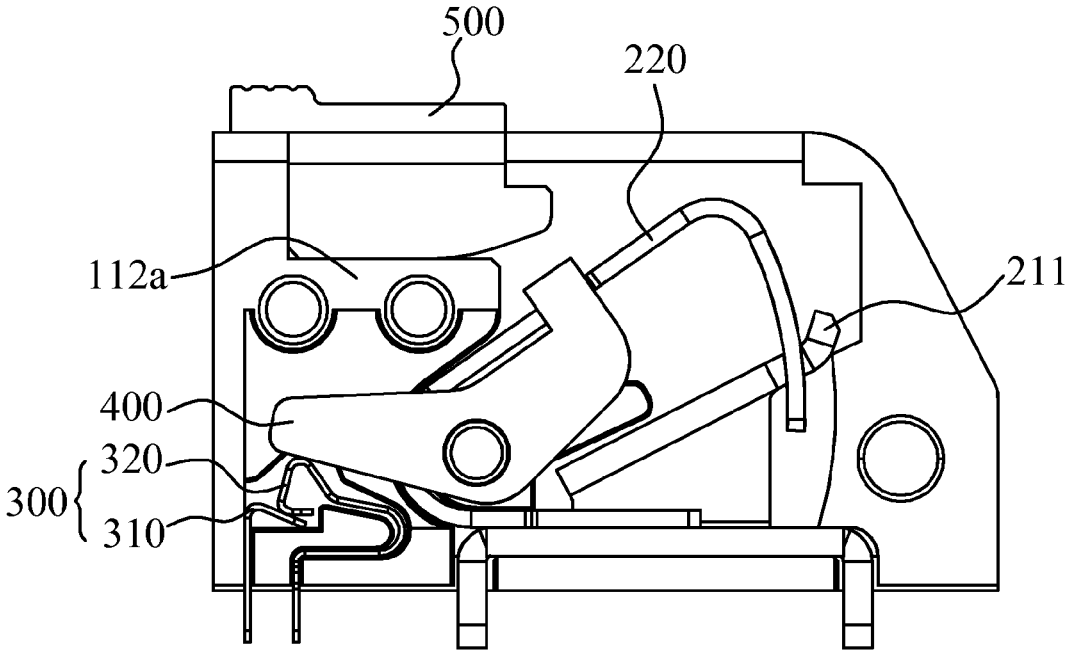
FIG. 4 to FIG. 7 are diagrams showing four different states of the cable connector shown in FIG. 3.
Figure 5:
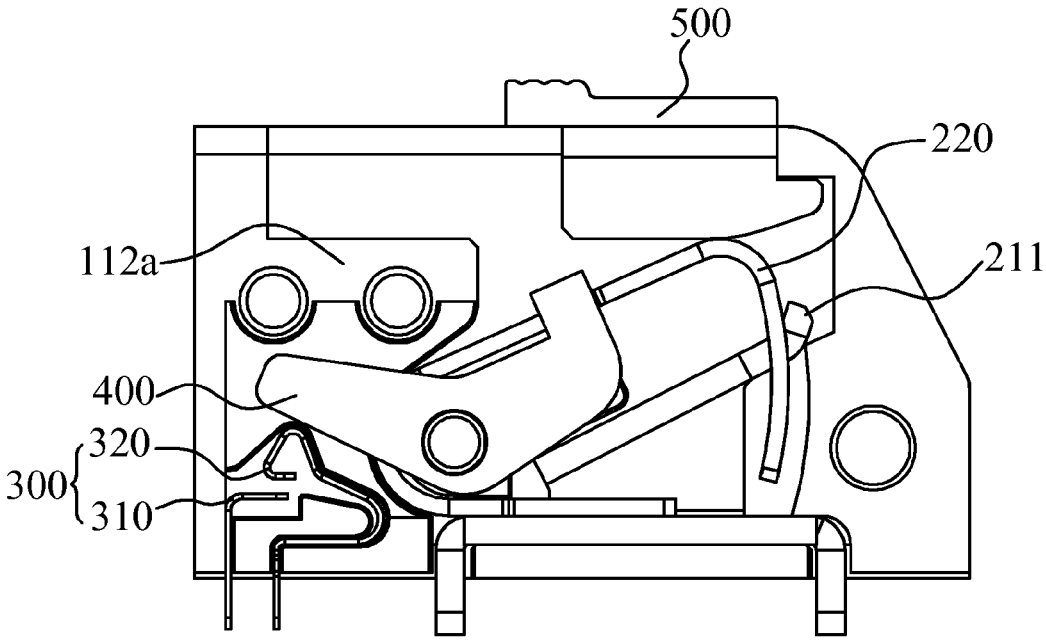
Figure 6:
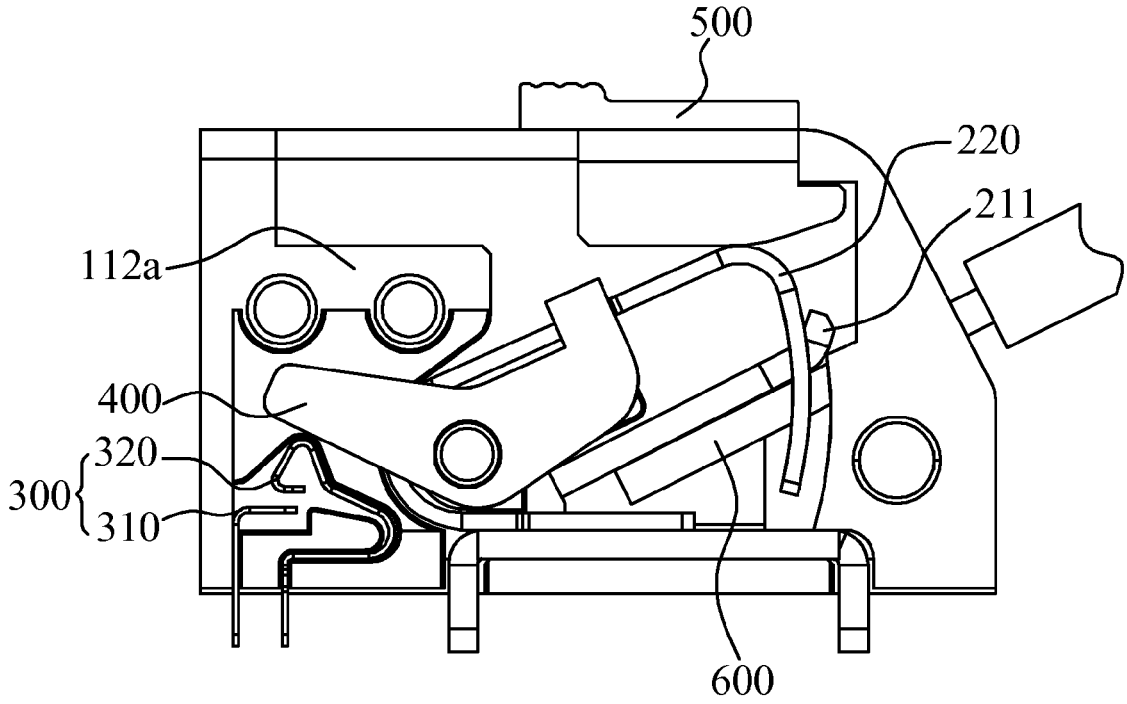
Figure 7:
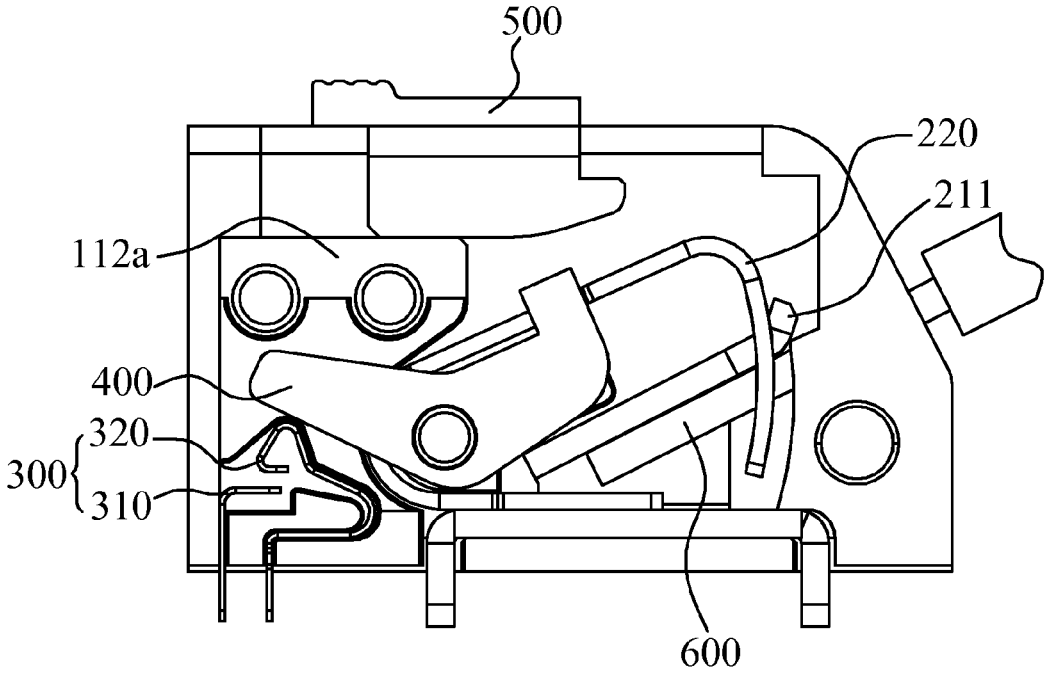

When the cable connector 10 of the present invention is in a normal state (as shown in FIG. 4), the pushing member 500 stops on the first protruded stand 112*a* and does not apply any force to the movable conductive terminal 220. Meanwhile, the linkage member 400 can press downward to the movable switch terminal 320 such that the movable switch terminal 320 is connected to the fixed switch terminal 310 (the switch terminal set 300 is in a "turned-on" state). When the pushing member 500 is pushed to a position shown in FIG. 5, the movable conductive terminal 220 is moved downward under the pressure of the pushing member 500. The movement of the movable conductive terminal 220 further induces a rotation of the linkage member 400 (rotating in a clockwise direction as shown in FIG. 5) such that the pressure on the movable switch terminal 320 is released. Therefore, the holding plate 211 of the upper end of the fixed conductive terminal 210 is moved up relative to the slot 221 and the movable switch terminal 320 is separated with the fixed switch terminal 310 (the switch terminal set 300 is in a "turned-off" state). In the meantime, as shown in FIG. 6, the downward movement of the movable conductive terminal 220 makes the slot 221 moved down as well such that the slot 221 is aligned with the inserting hole 113. The cable 600 can be inserted into the slot 221 and stuck in the slot 221. At this moment, even when the pushing member 500 is pushed away from the movable conductive terminal 220, the switch terminal set 300 will be still in the "turned-off" state, as shown in FIG. 7. This is because the movable conductive terminal 220 is forced down due to the insertion of the cable 600.

Above all, the cable connector 10 having switching function in the present invention can fulfill circuit state determination by the cooperation of the switch terminal set 300, the linkage member 400, the pushing member 500, and other elements, in which inserting the cable 600 into the cable connector 10 and pulling out the cable 600 from the cable connector 10 can corresponds to the "turned-on" state and the "turned-off" state of the switch terminal set 300.

What is claimed is:

1. A cable connector having switching function, comprising:

an insulating body comprising a base and a side cover, the base having a front wall which is perforated to form an inserting hole that is provided for being inserted by a cable;

a conductive terminal set assembled in the base, the conductive terminal set comprising a fixed conductive terminal and a movable conductive terminal, the fixed conductive terminal connecting to a lower end of the movable conductive terminal, an upper end of the movable conductive terminal being perforated to form a slot facing the inserting hole, a lower end of the fixed conductive terminal being extended from the base, an upper end of the fixed conductive terminal being extended to the slot and able to be moved relative to the slot;

a switch terminal set assembled in the base, the switch terminal set comprising a fixed switch terminal and a movable switch terminal, an upper end of the fixed switch terminal and an upper end of the movable switch terminal forming a detachable connection, a lower end of the fixed switch terminal and a lower end of the movable switch terminal being extended from the base;

a linkage member pivoted in the base, an upper end of the linkage member connecting to a middle portion of the movable conductive terminal, the upper end of the movable switch terminal being placed against a lower end of the linkage member; and a pushing member slidably assembled in the base for pressing down onto the movable conductive terminal.

2. The cable connector according to claim 1, wherein the pushing member has an oblique plane facing a bottom surface on a side of the movable conductive terminal.

3. The cable connector according to claim 1, wherein the pushing member has a first groove and a second groove respectively formed on two lateral walls thereof, a top portion of the base is perforated to form an opening for accommodating the pushing member, a first ridge is formed at one side of the opening for engaging with the first groove, a second ridge is formed on an upper portion of the side cover for engaging with the second groove.

4. The cable connector according to claim 1, wherein the pushing member has a wave-shaped surface formed on a top portion thereof.

5. The cable connector according to claim 1, wherein an upper end of the linkage member has a fixing recess formed thereon, the middle portion of the movable conductive terminal has a protrusion formed thereon, the protrusion is stuck in the fixing recess such that the middle portion of the movable conductive terminal is connected to the linkage member.

6. The cable connector according to claim 1, wherein the base has a chamber for accommodating the conductive terminal set, the switch terminal set, the linkage member, and the pushing member, the chamber has a first protruded stand and a second protruded stand disposed therein, the first protruded stand is utilized for supporting the pushing member and the second protruded stand is utilized for supporting the movable conductive terminal.

7. The cable connector according to claim 6, wherein the movable conductive terminal is a flexible structure wound around the second protruded stand.

8. The cable connector according to claim 1, wherein the base has a fixed shaft disposed thereon and a middle portion of the linkage member is pivotally connected to the fixed shaft.

9. The cable connector according to claim 1, wherein the base has a few protruded shafts disposed thereon, the side cover is perforated to form a few fixing bores corresponding to the protrude shafts, the side cover is fastened to the base by engaging the fixing bores with the corresponding protrude shafts.

10. The cable connector according to claim 1, wherein the inserting hole is a hole having a funnel shape.

11. The cable connector according to claim 2, wherein the inserting hole is a hole having a funnel shape.

12. The cable connector according to claim 3, wherein the inserting hole is a hole having a funnel shape.

13. The cable connector according to claim 4, wherein the inserting hole is a hole having a funnel shape.

14. The cable connector according to claim 5, wherein the inserting hole is a hole having a funnel shape.

15. The cable connector according to claim 6, wherein the inserting hole is a hole having a funnel shape.

16. The cable connector according to claim 7, wherein the inserting hole is a hole having a funnel shape.

17. The cable connector according to claim 8, wherein the inserting hole is a hole having a funnel shape.

18. The cable connector according to claim 9, wherein the inserting hole is a hole having a funnel shape.

* * * * *